United States Patent [19]

Zakurdaev et al.

[11] 4,200,779

[45] Apr. 29, 1980

[54] DEVICE FOR SWITCHING ELECTRICAL CIRCUITS

[75] Inventors: Anatoly V. Zakurdaev; Andrei B. Luzhensky, both of Moscow, U.S.S.R.

[73] Assignee: Moscovsky Inzhenerno-Fizichesky Institut, U.S.S.R.

[21] Appl. No.: 937,097

[22] Filed: Aug. 28, 1978

[30] Foreign Application Priority Data

Sep. 6, 1977 [SU] U.S.S.R. ..... 2520712[I]

[51] Int. Cl.[2] ..... H01H 29/28

[52] U.S. Cl. ..... 200/187; 200/181; 200/191; 200/211

[58] Field of Search ..... 200/181, 183, 187, 188, 200/211, 191

[56] References Cited

U.S. PATENT DOCUMENTS

| | | | |
|---|---|---|---|
| 1,638,814 | 8/1927 | Epstein | 200/188 X |
| 2,587,482 | 2/1952 | Keller | 200/181 |
| 2,744,980 | 5/1956 | Bellamy | 200/183 X |

FOREIGN PATENT DOCUMENTS

| | | |
|---|---|---|
| 1811489 | 5/1972 | Fed. Rep. of Germany . |
| 333699 | 3/1972 | U.S.S.R. . |

*Primary Examiner*—Frederick R. Schmidt
*Attorney, Agent, or Firm*—Steinberg and Blake

[57] ABSTRACT

A device for switching a plurality of electrical circuits, each including a group of electrodes separated by insulators and a duct formed by coaxial holes made in the electrodes and insulators and filled partially with a conducting liquid wetting the surface of the electrodes within the duct. An element controls the flow of conducting liquid within the duct so as to close the electrodes. The element is linked mechanically with a duct sealing element in common with the ducts of all the groups. The sealing element has a cavity filled with a dielectric liquid communicating with the ducts of all the groups.

1 Claim, 4 Drawing Figures

DEVICE FOR SWITCHING ELECTRICAL CIRCUITS

FIELD OF THE INVENTION

This invention relates to liquid-contact switches and more particularly to devices for switching the electrical circuits of automatic control, communication and data system instruments.

The invention is meant preferably for use in multiconductor d.c. and a.c. radioelectronic, measuring and computer circuits, industrial automatic control systems and, also, for switching the sound channel of communication systems.

BACKGROUND OF THE INVENTION

Known in the art is a device for switching electrical circuits USSR Inventor's Certificate No. 333, 669; Cl. H03K 17/00), comprising a hermetically sealed duct passing through metal electrodes and insulating layers separating them and partially filled with a conducting liquid (mercury) wetting the surface of the electrodes within the duct.

The switchover of the device from one stable state to another by means of a current pulse that is applied to the respective pair of electrodes, destroys the liquid conducting bridge across the electrodes.

Also known is a device for switching electrical circuits (cf. FRG Pat. No. 1,811,489, Cla. 21 c 33/01), based on a group comprising electrodes separated by insulators and having a duct formed by coaxial holes made in the electrodes and insulators and filled partially with a conducting liquid (mercury) wetting the surface of the electrodes and the duct. Each duct of the device has an individual sealing element preventing the leakage of conducting liquid from the channel and linked mechanically with the element controlling the flow of conducting liquid within the duct so as to close the electrodes. The control element is in the form of a piezoelectric unit producing a compressive or rarefying acoustic wave that alters the position of the conducting liquid within the channel.

In switching multi-line interconnecting channels of communication and information systems where it becomes necessary to employ several similar known devices, the switching cannot be synchronized properly, since each contact has its own control element. Furthermore, the known device has a considerable specific volume and a high specific control power consumption.

SUMMARY OF THE INVENTION

It is an object of the invention to provide for synchronous switching of several electrical circuits when switching over multi-line interconnecting channels of communication and data systems.

It is another object of the present invention to reduce the specific volume of the electrical circuit switching device.

Still another object of the present invention is to lower the specific control power consumption of the hereinproposed device.

These and other objects are attained by a device for switching electrical circuits, based on a group comprising electrodes separated by insulators and having a duct formed by coaxial holes made in the electrodes and insulators and filled partially with a conduting liquid wetting the surface of the electrodes in the duct. The device is provided with a sealing element linked mechanically with an element controlling the flow of conducting liquid within the duct so as to close the electrodes. The device in accordance with the present invention switches a plurality of circuits, each including a group of electrodes and has a duct sealing element in common with all the groups. The sealing element has a cavity filled with a dielectric liquid communicating with the ducts of all the groups.

Simultaneous switching of all the electrical circuits is ensured by synchronously altering the position of the conducting liquid in all the ducts of the groups.

BRIEF DESCRIPTION OF ACCOMPANYING DRAWINGS

The invention will now be described in greater detail with reference to specific embodiments thereof, taken in conjunction with the accompanying drawings wherein.

DETAILED DESCRIPTION OF THE INVENTION

Figure 1:
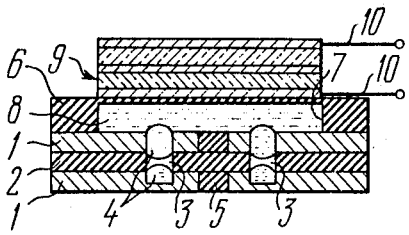
FIG. 1 is a sectional view of a device of the invention for switching electrical circuits with the electrodes of each group electrically separated.

In accordance with the invention, the device for switching electrical circuits is based on several groups, each comprising electrodes 1 (see FIG. 1) separated by an insulator 2 and a duct 3 formed by coaxial holes made in the electrodes 1 and the insulator 2. The duct 3 is filled partially with a conducting liquid 4 (e.g. mercury) wetting the surface of the electrodes 1 and the duct 3. Each of the switched electrical circuits, includes a group. The groups are separated electrically from each other by the insulators 5. The conducting liquid 4 inside each duct 3 may be in two opposite and reversible stable states with the electrodes open or electrically separated, or with the electrodes closed or in electrical contact. In the initial position (see FIG. 1), the electrodes 1 are open or electrically separated, and in the opposite state (FIG. 2), the electrodes are closed or in electrical contact. The sealing element 6 (see FIG. 1) of the ducts 3 is in common with all the groups and has a cavity 7 filled with a dielectric liquid 8 that communicates with all the ducts 3. The control element 9 controlling the flow of the conducting liquid 4 inside the duct 3 so as to open the electrodes 1 is linked mechanically with the sealing element 6 and is piezoelectric element connected to the control electrodes 10.

Figure 3:
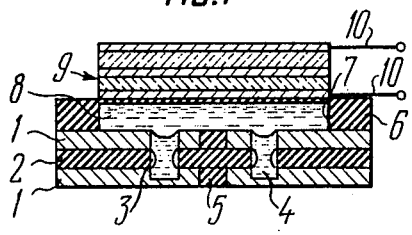
FIG. 3 is a sectional view of the device of the invention for switching electrical circuits with the electrodes of each group in electrical contact.
Figure 4:
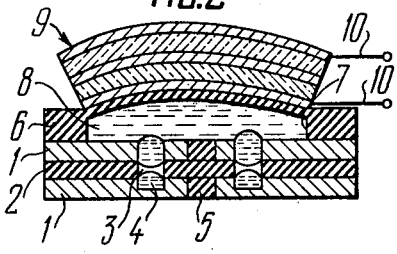
FIG. 4 is a sectional view of the device of FIG. 3, in the opposite stable state with the electrodes of each group electrically separated.

FIG. 3 shows an embodiment of the device, wherein the electrodes 1 are closed, or in electrical contact, in the initial state, and are open, or electrically separated, in the opposite state (see FIG. 4).

Figure 2:
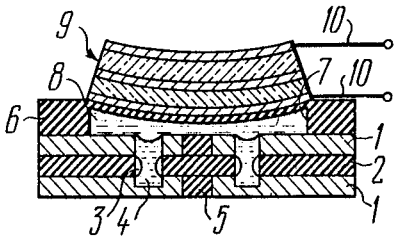
FIG. 2 is a sectional view of the device of FIG. 1 with the electrodes of each group in electrical contact in the opposite stable state.

The device which closes the initially open contacts, shown in FIG. 1, operates in the following manner. On supply of a control voltage to the electrodes 10 of the control element 9, the piezoelectric element deflects and deforms one of the walls of the cavity 7, thus reducing its volume. The compressive wave produced thereby is passed simultaneously through the dielectric liquid 8 to all the ducts 3 and synchronously alters the position of the conducting liquid 4 in all the ducts 3, thereby closing all the electrical circuits simultaneously.

When the control voltage is switched off, the piezoelectric element and the deformed wall of the cavity 7 of the sealing element 6 return back to the initial position. As a result, the conducting liquid 4 simultaneously comes back to the initial state in all the ducts 3, thereby separating the electrodes, and synchronously opens all the electrical circuits.

The device with initially closed contacts shown in FIG. 3 operates in a similar manner, the only difference being that the electric circuits are opened simultaneously by the rarefying wave transferring through the dielectric liquid 8 (FIG. 4).

The hereinproposed device ensures a high synchronism of operation of the contacts (in any number) when switching multi-line d.c. and a.c. circuits.

The present device for switching electrical circuits is resistant to vibration and impacts over a wide range of frequencies and accelerations, is almost unsusceptible to the effect of external electric fields, has a low and stable contact resistance and short contact making time.

The device may be made to retain or not retain the contacts in set position after the control signal is discontinued.

The simple design features of the hereinproposed device permit it to be reduced to the size of printed-circuit cards or film-type electronic components and to provide for maximum reduction in volume and power consumption per switched contact.

What is claimed is:

1. A device for switching electrical circuits, comprising a plurality of electrical circuits, each including a group of electrodes separated by insulators;

a duct in each said group formed by coaxial holes in said electrodes and insulators and filled partially with a conducting liquid wetting the surface of said electrodes within said duct;

a duct sealing element in common with all said ducts;

a cavity in said duct sealing element filled with a dielectric liquid communicating with said ducts of all said groups; and an element mechanically linked to said duct sealing element for controlling the flow of said conducting liquid within said ducts by acting on said duct sealing element and producing a compressive wave which is passed simultaneously through the dielectric liquid to all said ducts and synchronously alters the position of the conductive liquid in all said ducts simultaneously thereby selectively placing said electrodes in electrical contact or electrically separating said electrodes.

* * * * *